US009835055B2

(12) United States Patent
Gerzner et al.

(10) Patent No.: US 9,835,055 B2
(45) Date of Patent: Dec. 5, 2017

(54) PULLABLE DRAWER FOR A TURBINE AND TURBINE WITH SUCH A DRAWER

(71) Applicant: ALSTOM Technology Ltd, Baden (CH)

(72) Inventors: Stefan Gerzner, Freudwil (CH); Marc Rauch, Frenkendorf (CH); Ernst Vogt, Remigen (CH); Jose-Manuel Lopez, Gipf-Oberfrick (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 246 days.

(21) Appl. No.: 14/661,571

(22) Filed: Mar. 18, 2015

(65) Prior Publication Data

US 2015/0267562 A1 Sep. 24, 2015

(30) Foreign Application Priority Data

Mar. 20, 2014 (EP) ..... 14160808

(51) Int. Cl.
*F01D 25/26* (2006.01)
*F01D 25/28* (2006.01)

(52) U.S. Cl.
CPC ..... *F01D 25/26* (2013.01); *F01D 25/28* (2013.01); *F01D 25/285* (2013.01); *F05D 2230/644* (2013.01)

(58) Field of Classification Search
CPC ..... F01D 25/285; F01D 25/243; F01D 25/26; F01D 25/265; F01D 25/28; F05D 2230/644; F05D 2240/90; Y10T 403/7094
See application file for complete search history.

(56) References Cited

U.S. PATENT DOCUMENTS 596,490 A * 1/1898 Edwards ..... E21B 17/046 135/114
3,628,884 A 12/1971 Mierley, Sr. et al.
(Continued)

FOREIGN PATENT DOCUMENTS

CN 101550844 A 10/2009
CN 102482945 A 5/2012
(Continued)

OTHER PUBLICATIONS

Office Action (First Office Action) dated Jul. 5, 2017, by the State Intellectual Property Office (SIPO) of the People's Republic of China in corresponding Chinese Patent Application No. 201510123598.8, and an English Translation of the Office Action. (14 pages).

*Primary Examiner* — Dwayne J White
*Assistant Examiner* — Peter T Hrubiec
(74) *Attorney, Agent, or Firm* — Buchanan Ingersoll & Rooney PC

(57) ABSTRACT

An exemplary pullable drawer is arranged for removably protruding in a radial direction into an outer housing of a turbine, in order to make mechanical contact with an inner carrier being concentrically arranged within the outer housing. The pullable drawer has an essentially cylindrical body, which extends along a longitudinal drawer axis. A mechanical decoupling is provided, as the pullable drawer is divided along the longitudinal drawer axis into at least separate first and second parts. The first and second parts are coupled with each other by means of a releasable mechanical joint.

16 Claims, 5 Drawing Sheets

(56) References Cited

U.S. PATENT DOCUMENTS

| | | | | |
|---|---|---|---|---|
| 4,112,582 | A | 9/1978 | Beckershoff | |
| 4,645,373 | A * | 2/1987 | Purdy | F16B 7/042 24/644 |
| 5,333,964 | A * | 8/1994 | Thomas | B64G 1/641 403/294 |
| 6,224,332 | B1 | 5/2001 | Leach et al. | |
| 8,182,207 | B2 | 5/2012 | Ballard, Jr. et al. | |
| 8,794,587 | B2 | 8/2014 | Cant et al. | |
| 8,870,529 | B2 | 10/2014 | Casavant et al. | |
| 8,870,533 | B2 | 10/2014 | Casavant | |
| 2009/0226313 | A1* | 9/2009 | Morimoto | F01D 25/285 415/214.1 |
| 2009/0232651 | A1 | 9/2009 | Ballard, Jr. et al. | |
| 2012/0168601 | A1 | 7/2012 | Cant et al. | |
| 2013/0017082 | A1 | 1/2013 | Casavant | |
| 2013/0039749 | A1 | 2/2013 | Casavant et al. | |

FOREIGN PATENT DOCUMENTS

| | | | |
|---|---|---|---|
| CN | 102877900 | A | 1/2013 |
| CN | 102953774 | A | 3/2013 |
| DE | 42 30 235 | A1 | 3/1994 |
| WO | 2011/026516 | A1 | 3/2011 |

* cited by examiner

PULLABLE DRAWER FOR A TURBINE AND TURBINE WITH SUCH A DRAWER

CROSS-REFERENCE TO RELATED APPLICATIONS

This application claims priority to European application 14160808.3 filed Mar. 20, 2014, the contents of which are hereby incorporated in its entirety.

TECHNICAL FIELD

The present invention relates to turbines, especially gas turbines. It refers to a pullable drawer according to the preamble of claim 1. It further refers to a gas turbine with such a pullable drawer.

BACKGROUND

Gas turbines, especially of the stationary or industrial type, usually have an outer housing, which coaxially extends along a machine axis and surrounds a concentric inner carrier, which carries the vanes of the turbine. The outer housing and the inner carrier are separate units, each comprising an upper part and a lower part, both having the form of a half cylinder, which are connected by means of a flanged connection at a common parting plane.

For positioning the inner carrier relative to the outer housing a mechanical connection is established between both parts by means of a plurality of drawers, which extend at certain places through the outer housing to make mechanical contact with the inner carrier.

Document U.S. Pat. No. 3,628,884 A discloses a rotary machine, such as a turbine. The machine comprises a tubular outer casing and a tubular inner casing disposed within the outer casing. The inner casing encompasses a rotating rotor structure.

Hot motive gases, derived from fuel combustion, are expanded as they flow through the machine to drive the rotor structure, as well known in the art.

A plurality of apertures is radially disposed in the outer casing and a plurality of corresponding key slots is disposed on the periphery of the inner casing. After the outer and inner casings are aligned concentrically relative to the axis of rotation of the rotor, a plurality of eccentric bushing structures are radially disposed in the apertures and adjusted to fit the slots to support the inner casing concentrically relative to the axis of rotation of the rotor.

Document U.S. Pat. No. 6,224,332 B1 discloses a turbine having an outer structural shell and an inner shell supported by the outer shell. The inner shell carries an array of nozzles and forming parts of first and second stages, respectively, of the turbine.

To connect the inner and outer shells to one another, each of the forward and aft portions of the inner shell are provided with circumferentially spaced recesses. Support pins pass through access openings through the outer shell for connection with the forward portion of the inner shell. Similar pins interconnect the outer shell with the all portion of the inner shell. Preferably, the pins lie at eight pin locations in each radial plane and are spaced approximately 45° one from the other about the rotor axis. The support pins are also spaced from the horizontal split line of the inner shell. The support pins include an enlarged head having a bolt circle with a plurality of bolt openings, a cylindrical shank and end projections. The support pins support the inner shell from the outer shell for radial and axial expansion and contraction, with the pins carrying only circumferential loadings.

Document US 2009/0226313 A1 discloses a turbine casing structure having an outer casing, and an inner casing disposed in the outer casing, comprising a bush disposed in a concave portion formed in the inner casing; an eccentric shaft inserted into a communication hole formed in the outer casing, and having a front end disposed in contact with the bush; and a fixing member disposed in engagement with the eccentric shaft, and fixed to the outer casing.

Document US 2013/0017082 A1 describes an alignment assembly for mounting and aligning an inner shell within an outer shell. The alignment assembly generally includes a first bushing and a second bushing configured to be received within at least one of an arm extending radially between the inner and outer shells and a boss of the outer shell. The first bushing may generally have an eccentric configuration and the second bushing may include an eccentric portion extending within the first bushing. Additionally, the alignment assembly may include a connection member extending within at least one of said first bushing and said second bushing.

Other assemblies of inner vane carriers and outer housings or casings of turbine are known from documents DE 25 32 537 A1 and DE 42 30 235 A1.

The known solutions have some severe disadvantages:

- Due to a lack of mechanical decoupling, requirements on machining precision are very high in order to avoid an unwanted force impact on sensitive portions of the pullable drawers;
- Although designs of pullable drawers accessible from outside do exist, these existing designs show often problems due to unwanted force impact on sensitive portions of the drawer.

SUMMARY

It is an object of the present invention to provide pullable drawers for turbine housing assemblies, which avoid the disadvantages of the known designs and are easily assembled and disassembled in a very fast and failure-proof way.

It is another object of the invention to provide a gas turbine with such a pullable drawer.

These and other objects are obtained by a pullable drawer according to claim 1 and a gas turbine according to claim 11.

The pullable drawer according to the invention is provided for removably protruding in a radial direction into an outer housing of a turbine, especially gas turbine, in order to make mechanical contact with an inner carrier being concentrically arranged within said outer housing, whereby said pullable drawer has an essentially cylindrical body, which extends along a longitudinal drawer axis.

It is characterized in that said pullable drawer is divided along said longitudinal drawer axis into at least separate first and second parts, which first and second parts are coupled with each other by means of a releasable mechanical joint.

According to an embodiment of the pullable drawer of the invention said mechanical joint has at least one degree of freedom for the movement of said first and second parts relative to each other.

According to another embodiment of the pullable drawer of the invention said at least one degree of freedom is along a second axis perpendicular to said longitudinal drawer axis.

According to another embodiment of the pullable drawer of the invention said mechanical joint is a dovetail joint having a dovetail joint axis, and said dovetail joint axis is identical with said second axis.

According to a further embodiment of the pullable drawer of the invention said dovetail joint comprises a pin and a dovetail for receiving said pin in a sliding movement along said dovetail joint axis, said pin is provided at said first part of said pullable drawer, and said dovetail is provided at said second part of said pullable drawer.

According to another embodiment of the pullable drawer of the invention a spring is arranged within said dovetail joint between said pin and said dovetail in order to exert a separating force in axial direction between said first and second parts of said pullable drawer.

According to just another embodiment of the pullable drawer of the invention said spring is a leave spring, and a spring groove extending along said dovetail joint axis for receiving said leave spring is provided at the front face of the pin of the dovetail joint.

According to a further embodiment of the pullable drawer of the invention the leave spring comprises means for laterally fixing said leave spring in said spring groove.

According to another embodiment of the pullable drawer of the invention said fixing means comprises a vertical pin, which fits into a hole at the bottom of said spring groove.

According to just another embodiment of the pullable drawer of the invention said first part of said pullable drawer comprises a flat head the plane of which is oriented perpendicular to said dovetail joint axis.

The gas turbine according to the invention comprises a hollow cylindrical outer housing, which is coaxial with and extends along, a machine axis, and which is divided at a parting plane into an upper part and a lower part, and further comprises an inner carrier, which is concentrically surrounded by said outer housing, and which is divided at said parting plane into an upper part and a lower part, whereby said outer housing and said inner carrier are mechanically coupled by a plurality of pullable drawers, which extend through said outer housing to contact said inner carrier.

It is characterized in that said pullable drawers are drawers according to the invention.

According to an embodiment of the inventive gas turbine said pullable drawers are arranged pair wise and symmetrically with regard to said parting plane.

According to another embodiment of the inventive gas turbine said upper part and lower part of said outer housing are connected in said parting plane by means of a flanged connection, and said pairs of pullable drawers are each arranged within said flanged connection.

According to just another embodiment of the inventive gas turbine said upper part and lower part of said inner carrier are connected in said parting plane by means of a flanged connection, and said pairs of pullable drawers have mechanical contact with said inner carrier at said flanged connection.

According to a further embodiment of the inventive gas turbine radially extending holding blocks are provided at said flanged connection of said inner carrier, and each pair of pullable drawers makes mechanical contact with a respective holding block at opposite sides of said holding block.

According to another embodiment of the inventive gas turbine said pullable drawers are retained within said flanged connection by means of covers mounted on the outside of said flanged connection.

BRIEF DESCRIPTION OF THE DRAWINGS

The present invention is now to be explained more closely by means of different embodiments and with reference to the attached drawings.

DETAILED DESCRIPTION

Figures 1A, 1B:
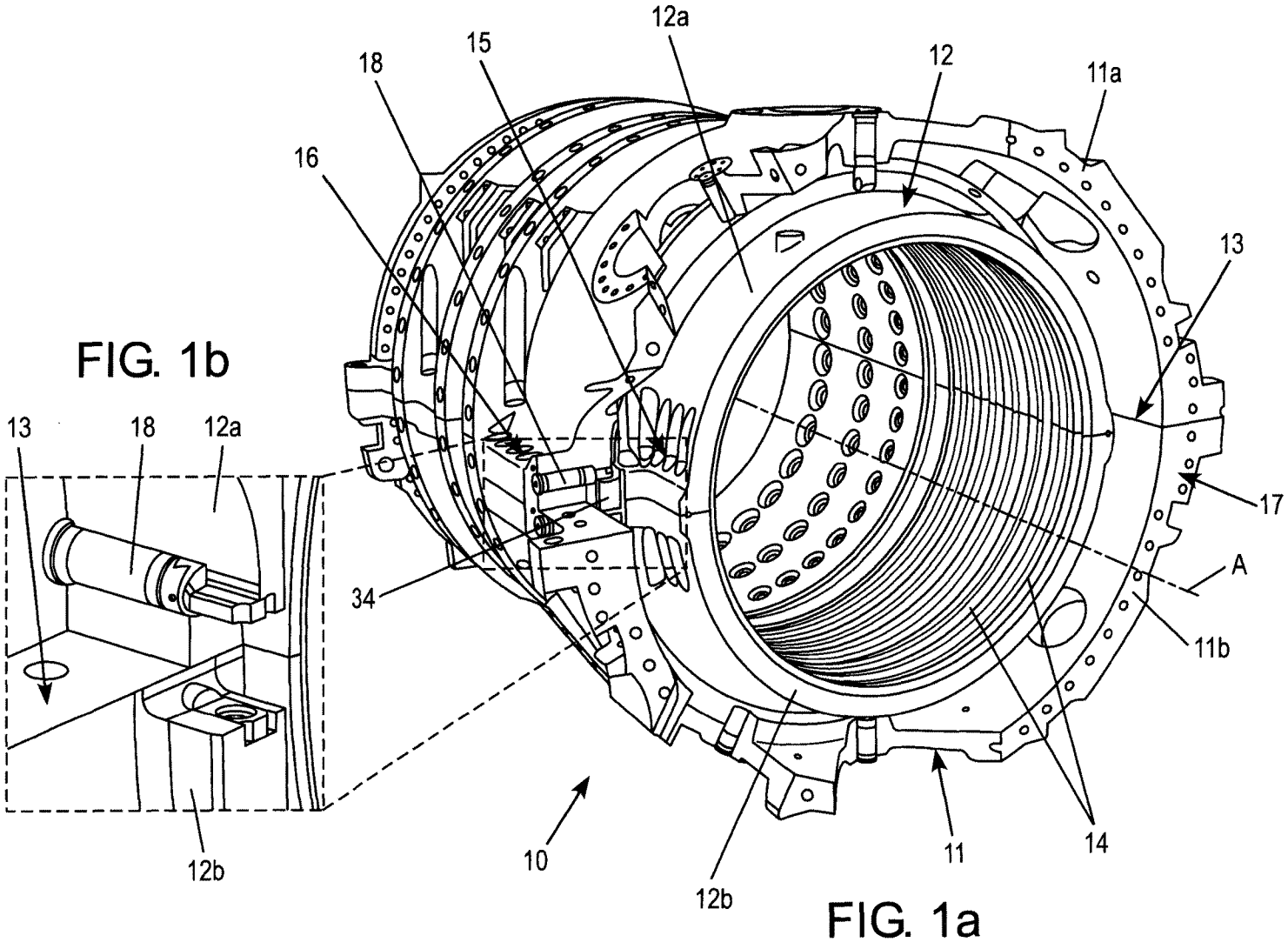
FIG. 1 shows part of a gas turbine assembly according to an embodiment of the invention with an outer housing and an inner carrier (FIG. 1(*a*)), and an enlarged detail of the flanged connections of the outer housing comprising pullable drawers according to an embodiment of the invention (FIG. 1(*b*))

FIG. 1 shows part of a gas turbine assembly according to an embodiment of the invention. The assembly of gas turbine 10 of FIG. 1(*a*) comprises a section of a hollow cylindrical outer housing 11, which is coaxial with and extends along, a machine axis A (the axis of rotation of a rotor not shown). The outer housing 11 is divided at a parting plane 13, which contains the machine axis A, into an upper part 11*a* and a lower part 11*b*. Gas turbine 10 further comprises an inner carrier 12, which is provided for carrying a plurality of vanes, which are mounted in respective circumferential vane receiving grooves 14 and extend radially into the interior of inner carrier 12. Inner carrier 12 is concentrically surrounded by outer housing 11, and is divided at said parting plane 13 into an upper part 12*a* and a lower part 12*b*.

Upper part 11*a* and lower part 11*b* of outer housing 11 are connected in parting plane 13 by means of a first flanged connection 16. Upper part 12*a* and lower part 12*b* of inner carrier 12 are connected in parting plane 13 by means of a second flanged connection 15. Outer housing 11 and inner carrier 12 are mechanically coupled by a plurality of pullable drawers 18, which extend through outer housing 11 to make mechanical contact with inner carrier 12. Only one pair of pullable drawers 18 is shown in FIG. 1(*a*) and the enlarged detail of FIG. 1(*b*).

Figures 2A, 2B:
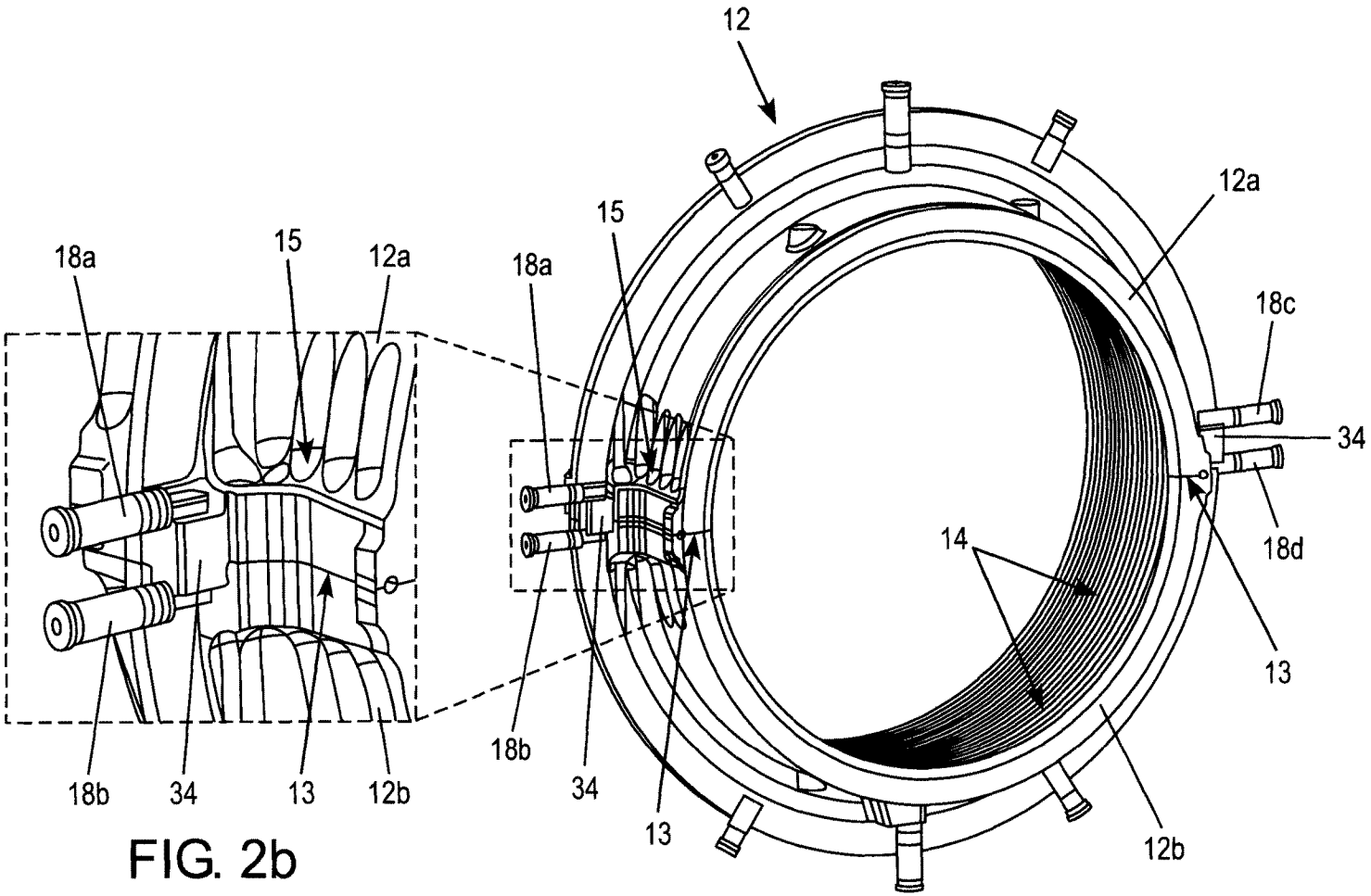
FIG. 2 shows the inner carrier of FIG. 1 and the mechanical contact with the pairs of pullable drawers (FIG. 2(*a*)), and one side of the inner casing with one pair of pullable drawers in an enlarged detail (FIG. 2(*b*))
Figure 3:
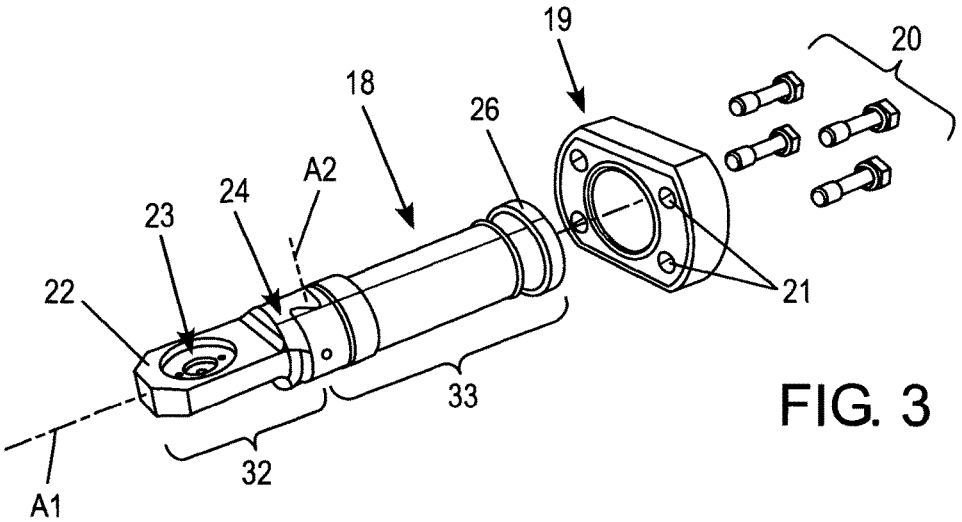
FIG. 3 shows a pullable drawer according to an embodiment of the invention, which is used in the assemblies of FIGS. 1 and 2.
Figure 4:
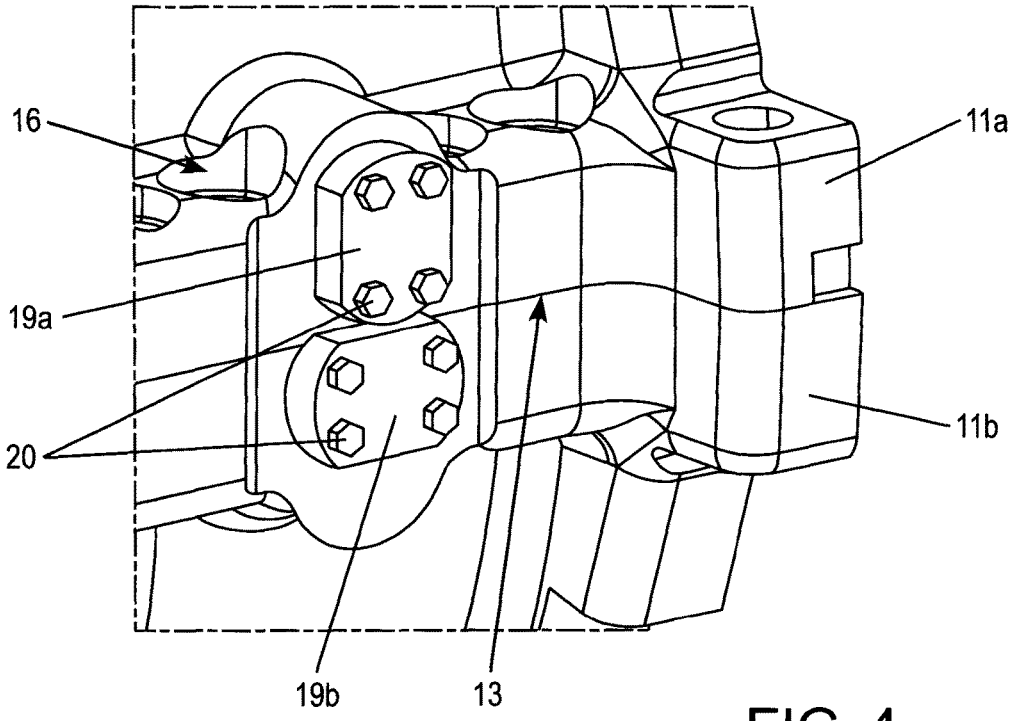
FIG. 4 shows in detail the enclosure of a pair of pullable drawers in the flanged connection of the outer housing.
Figure 5:
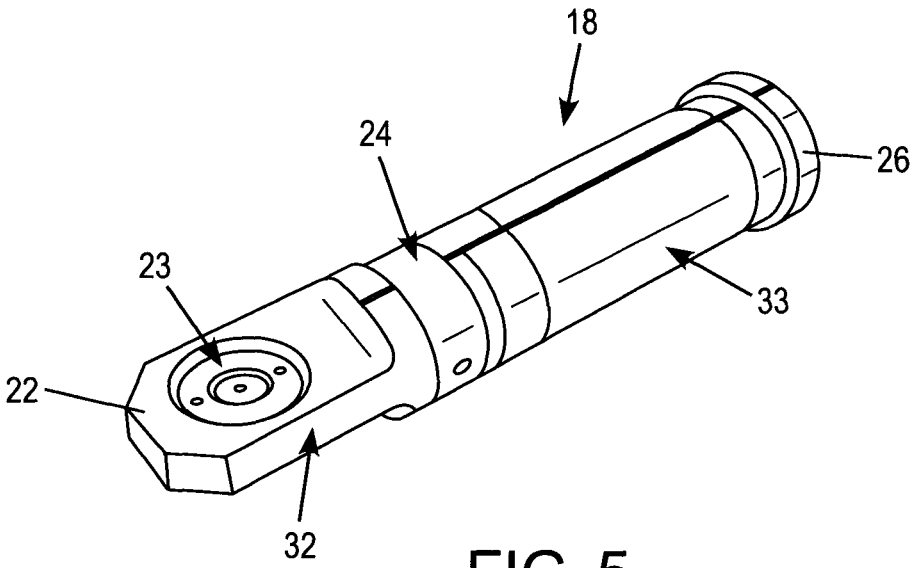
FIG. 5 is a photograph of the assembled pullable drawer of FIG. 3 in comparison with a writing pen.

FIG. 2 shows the inner carrier 12 of FIG. 1 and its mechanical contact with the two pairs of pullable drawers 18*a,b* and 18*c,d* (FIG. 2(*a*)), and one side of the inner casing with one pair of pullable drawers 18*a,b* in an enlarged detail (FIG. 2(*b*)). Pullable drawers 18*a,b* and 18*c,d* are mounted with a rear (cylindrical) part (33 in FIGS. 3 and 5-7) in respective bores in the flanged connection 16 of the outer housing (see FIG. 1) and make contact on opposite sides of a holding block 34, which is part of flanged connection 15 of inner carrier 12, by means of a head portion (32 in FIGS. 3 and 5-7). Mounted pullable drawers 18 are—as shown in FIG. 4—enclosed in their bores in flanged connection 16 by means of covers 19*a* and 19*b*, which are each bolted to flanged connection 16 by four screws 20 extending through respective screw holes 21 (see FIG. 3).

The technical problems that had to be solved are:

A mechanical decoupling of independent portions of a pullable drawer;

temperatures up to 500° C. must be tolerated;

ambient fluid pressure up to 30 bar must be tolerated;

a suppression of probable vibrations should be possible;

the drawer should be maintenance friendly, have few parts, be of robust design, and be failure-proof.

The basic idea of the invention is now a mechanical decoupling of the pullable drawers 18*a-d*, which protrude into the outer housing 11 of gas turbine 10. At the same time a suppression of vibrations may take place within the drawers.

According to the present invention and shown in FIGS. 3 and 5-7 pullable drawer 18 or 18*a-d* is divided along its longitudinal drawer axis A1 into at least separate first and second parts 32, 33, namely a head portion 32 and a rear part 33, which first and second parts 32, 33 are coupled with each other by means of a releasable mechanical joint 24. According to the embodiment shown in FIGS. 3 and 5-7 the mechanical joint 24 has at least one degree of freedom for the movement of said first and second parts 32, 33 relative to each other. In the embodiment shown this at least one degree of freedom is along a second axis A2 perpendicular to said longitudinal drawer axis A1 (see FIG. 3).

In the embodiment shown, said mechanical joint is a dovetail joint 24 having a dovetail joint axis, which is identical with said second axis A2. Dovetail joint 24 comprises on one hand a pin 24*a* and on the other hand a dovetail 24*b* for receiving said pin 24*a* in a sliding movement along said dovetail joint axis A2. Pin 24*a* is formed at said first part or head portion 32 of pullable drawer 18, while dovetail 24*b* is formed at said second or rear part 33 of pullable drawer 18.

To have a tight fit of dovetail joint 24 at the same time successfully suppress unwanted vibration, a spring 25 is arranged within dovetail joint 24 between pin 24*a* and dovetail 24*b*. Spring 25 exerts a separating force in axial direction between first and second parts 32, 33 of pullable drawer 18. Spring 25 is a leave spring comprising a stack of separate identical leaves. A spring groove 30 extending along dovetail joint axis A2 for receiving leave spring 25 is provided at the front face of pin 24*a* of dovetail joint 24. Leave spring 25 is laterally fixed in spring groove 30 by fixing means 29 in form of a vertical pin 29, which fits into a hole 31 at the bottom of spring groove 30.

At the end of rear part 33 of pullable drawer 18*a* shoulder 26 is provided, which fits into a respective diameter step of the bore, which receives the drawer in order to have a defined axial position of drawer 18 within flanged connection 16. Drawer 18 is fixed in this position by cover 19 or 19*a, b*, respectively.

Head portion 32 of drawer 18 comprises a flat head 22 the plane of which is oriented perpendicular to dovetail joint axis A2. With flat head 22 drawer 18 abuts against holding block 34 of flange connection 15 of inner carrier 12, thereby fixing inner carrier 12 in circumferential direction. A circular recess 23 in flat head 22 may be used to fix inner carrier 12 in a radial direction.

Figure 6:
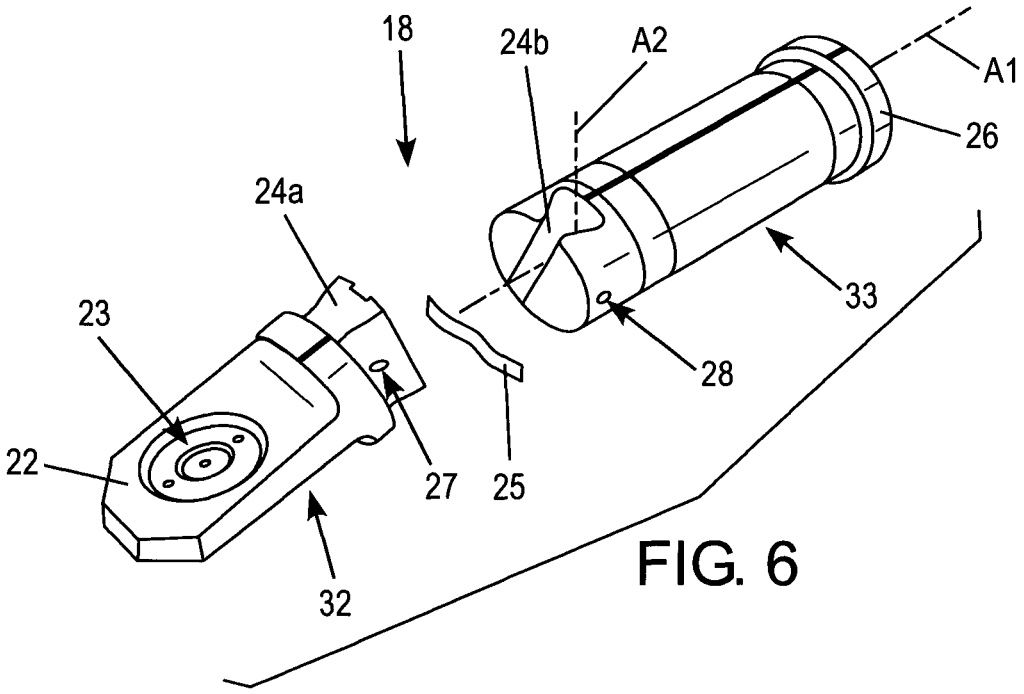
FIG. 6 is a photograph of the disassembled pullable drawer of FIG. 5 in comparison with a writing pen.
Figure 7:
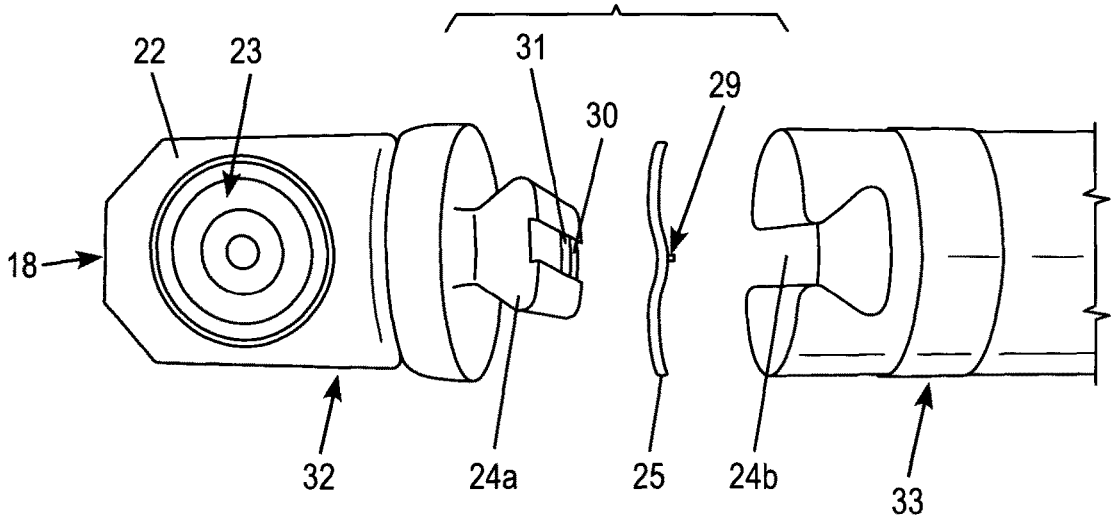
FIG. 7 is a photograph of an enlarged detail of the disassembled pullable drawer of FIG. 5.

As can be seen in FIG. 6, dovetail joint 24*a,b* may be provided with bores 27 and 28 in order to fix the joint by a bolt extending through these bores.

The drawer according to the invention thus comprises three portions:

Portion 1:

The rear part 33 of the pullable drawer 18, which represents a carrier of the head portion 32 of pullable drawer 18. Its purpose is to keep the head portion 32 in place axially, without suppressing a degree of freedom in the movement. This function is called "mechanical decoupling".

Portion 2:

The head portion 32 of pullable drawer 18. Its purpose is to fulfil the actual function of the feature. In the embodiment shown in the Figures it has to define a certain position for inner carrier 12 relative to the outer housing 11 of the gas turbine 10.

Portion 3:

Since the mechanical decoupling allows a certain movement in all degrees of freedom, unwanted vibrations are likely. The movement is suppressed by leave spring 25, which is also part of the solution.

The advantages of the present invention are:

Problems with rigid drawers with unwanted force impact are solved;

assembly and disassembly is easy, very fast and failure proof, which is very important for such a feature;

the pullable drawer of this invention is the first feature, which combines support drawers and accessibility from outside without time-consuming removing of burners, pipes etc., like it's done today to remove pullable drawers.

However, the invention is not limited to those drawers of the embodiment shown. Any item, which protrudes into the gas turbine and has to carry forces within a certain scope and shall be pullable from outside, could be equipped with such a mechanical decoupling.

The invention claimed is:

1. A pullable drawer for removably protruding in a radial direction into an outer housing of a turbine, in order to make mechanical contact with an inner carrier being concentrically arranged within said outer housing; said pullable drawer comprising:

an essentially cylindrical body, which extends along a longitudinal drawer axis, wherein said pullable drawer is divided along said longitudinal drawer axis into at least separate first and second parts, which first and second parts are coupled with each other by means of a releasable mechanical joint; and a spring arranged within the releasable mechanical joint for exerting a separating force in axial direction between said first and second parts.

2. The pullable drawer as claimed in claim 1, wherein said mechanical joint has at least one degree of freedom for the movement of said first and second parts relative to each other.

3. The pullable drawer as claimed in claim 2, wherein said at least one degree of freedom is along a second axis perpendicular to said longitudinal drawer axis.

4. The pullable drawer as claimed in claim 3, wherein said mechanical joint is a dovetail joint having a dovetail joint axis, and that said dovetail joint axis is identical with said second axis.

5. The pullable drawer as claimed in claim 4, wherein said dovetail joint comprises a pin and a dovetail for receiving said pin in a sliding movement along said dovetail joint axis, that said pin is provided at said first part of said pullable drawer, and that said dovetail is provided at said second part of said pullable drawer.

6. The pullable drawer as claimed in claim 5, wherein the spring is arranged within said dovetail joint between said pin and said dovetail.

7. The pullable drawer as claimed in claim 6, wherein said spring is a leave spring, and that a spring groove extending along said dovetail joint axis for receiving said leave spring is provided at the front face of the pin of the dovetail joint.

8. The pullable drawer as claimed in claim 7, wherein the leave spring comprises means for laterally fixing said leave spring in said spring groove.

9. The pullable drawer as claimed in claim 8, wherein said fixing means comprises a vertical pin, which fits into a hole at the bottom of said spring groove.

10. The pullable drawer as claimed in claim 4, wherein said first part of said pullable drawer comprises a flat head the plane of which is oriented perpendicular to said dovetail joint axis.

11. A gas turbine, comprising a hollow cylindrical outer housing, which is coaxial with and extends along, a machine axis, and which is divided at a parting plane into an upper part and a lower part, and further comprising an inner carrier, which is concentrically surrounded by said outer housing, and which is divided at said parting plane into an upper part and a lower part, whereby said outer housing and said inner carrier are mechanically coupled by a plurality of pullable drawers, which extend through said outer housing to contact said inner carrier, wherein said pullable drawers are drawers according to claim 1.

12. The gas turbine as claimed in claim 11, wherein said pullable drawers are arranged pair wise and symmetrically with regard to said parting plane.

13. The gas turbine as claimed in claim 12, wherein said upper part and lower part of said outer housing are connected in said parting plane by means of a flanged connection, and that said pairs of pullable drawers are each arranged within said flanged connection.

14. The gas turbine as claimed in claim 13, wherein said upper part and lower part of said inner carrier are connected in said parting plane by means of a flanged connection, and that said pairs of pullable drawers have mechanical contact with said inner carrier at said flanged connection.

15. The gas turbine as claimed in claim 14, further comprising radially extending holding blocks are provided at said flanged connection of said inner carrier, and that each pair of pullable drawers makes mechanical contact with a respective holding block at opposite sides of said holding block.

16. The gas turbine as claimed in claim 13, wherein said pullable drawers are retained within said flanged connection by means of covers mounted on the outside of said flanged connection.

* * * * *